United States Patent [19]

Lambert et al.

[11] 3,952,637

[45] Apr. 27, 1976

[54] APPARATUS FOR CHANGING THE ROTARY POSITION OF A SLOTTER MEMBER AND FOR CHANGING THE RELATIVE POSITION BETWEEN FIXED AND MOVABLE KNIVES ON THE SLOTTER MEMBER

[75] Inventors: Roy Ralph Lambert; Gordon Lawrence Morgret, both of Baltimore, Md.

[73] Assignee: Koppers Company, Inc., Pittsburgh, Pa.

[22] Filed: Apr. 14, 1975

[21] Appl. No.: 567,488

[52] U.S. Cl. ..... 93/58.2 R; 83/332; 83/522; 83/699

[51] Int. Cl.[2] ..... B31B 1/22; B26D 7/26

[58] Field of Search ..... 83/332, 675, 678, 522, 83/699; 93/58.2 R, 58.2 F

[56] References Cited

UNITED STATES PATENTS

| | | | |
|---|---|---|---|
| 1,670,314 | 5/1928 | Pearsall | 83/332 |
| 1,670,317 | 5/1928 | Seymour | 83/332 |
| 2,701,613 | 2/1955 | Bishop | 83/332 |
| 3,067,643 | 12/1962 | Ward, Jr. | 83/332 |
| 3,466,982 | 9/1969 | Sullivan | 93/58.2 R |

*Primary Examiner*—Frank T. Yost
*Attorney, Agent, or Firm*—Oscar B. Brumback; Boyce C. Dent

[57] ABSTRACT

Herein disclosed is an apparatus for changing the rotary position of a slotter member and for changing the relative position between fixed and movable knives mounted on the slotter member. The apparatus comprises a first rotatable shaft having at least one of the slotter members secured thereto; the slotter member having a fixed knife secured thereto and a movable knife mounted thereon; a driving apparatus; a first phase changing mechanism connected between the first shaft and the driving apparatus for rotating the slotter member; a second rotatable shaft spaced from the first shaft; a linking mechanism connected between the second shaft and the movable knife on the slotter member; a second phase changing mechanism connected between the first shaft and the second shaft for rotating the movable knife through the linking apparatus; and a selectively operable remote control apparatus for operating the first phase changing mechanism to selectively change the rotary position of the slotter member forward and backward with respect to the driving apparatus, the second phase changing mechanism and the linking mechanism maintaining the relative position of the fixed and movable knives during operation of the first phase changing mechanism, and for operating the second phase changing mechanism independently of the driving apparatus to selectively change the position of the movable knife forward and backward relative to the position of the fixed knife.

16 Claims, 7 Drawing Figures

FIG. 2
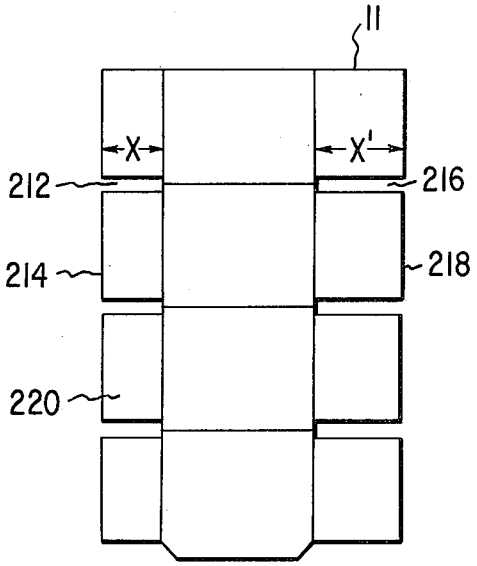
FIG. 3
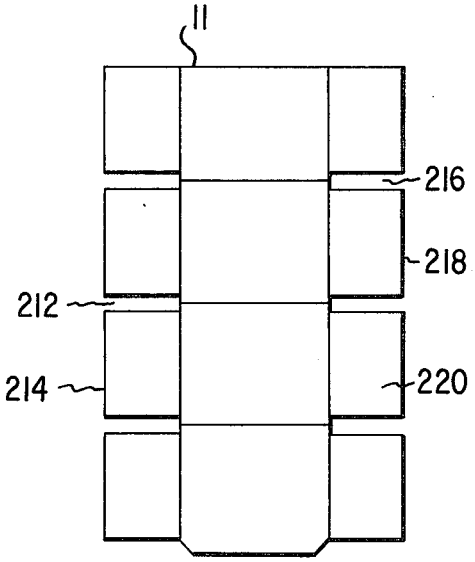
BLANK TRAVEL
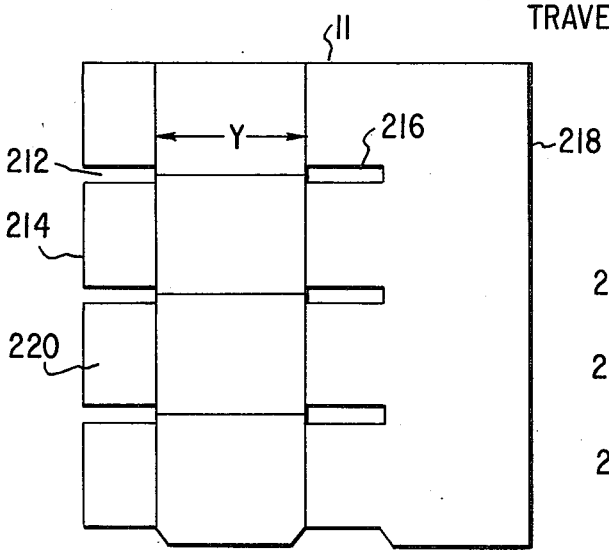
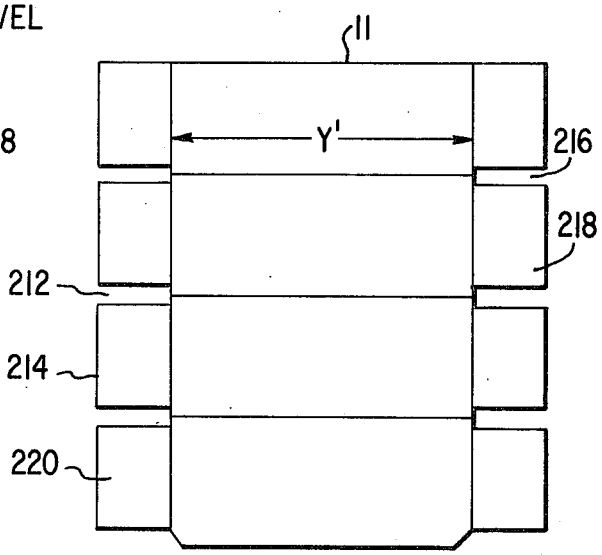
FIG. 4
FIG. 5

APPARATUS FOR CHANGING THE ROTARY POSITION OF A SLOTTER MEMBER AND FOR CHANGING THE RELATIVE POSITION BETWEEN FIXED AND MOVABLE KNIVES ON THE SLOTTER MEMBER

BACKGROUND OF THE INVENTION

1. Field of the Invention

This invention relates generally to cutting by a rotary tool having a segmented disc slitting or slotting tool and more particularly to an apparatus for changing the rotary position of a slotter member and for changing the relative position between fixed and movable knives on the slotter member.

2. Description of the Prior Art

In the slotting of corrugated paperboard blanks it is customary to use three rotary slotting members on a shaft which have a fixed slotting knife and a movable slotting knife thereon to cut slots in the paperboard blank to produce the flaps necessary for forming a corrugated box in which items are to be packed. To form the flaps on a corrugated box blank one knife on the slotting member is used to form the front slots on the leading edge of the box blank passing under the slotting member and the other knife is used to form the slots on the trailing edge of the box blank. To insure that the same size flaps are produced on both the leading edge of the box blank and the trailing edge of the box blank, it is necessary that one knife of the slotting member be in register with the leading edge of the blank as it passes beneath the slotting member. If the leading knife does not register with the leading edge of the box blank, slots of different lengths will be formed on the leading and trailing edge of the box blank forming flaps of different lengths. In addition, one knife on the slotting member is movable so that the angle between the fixed knife and the movable knife can be varied. This is necessary to insure that slots of equal length are formed at the leading and trailing edges of the box blank when a box blank of different size is to be run.

Heretofore, various apparatuses have been used to register one knife of the slotting member with the leading edge of a box blank passing thereunder, and for changing the angle between the movable knife with the fixed knife on the slotting member to produce flaps of equal length when it is desired to change the size of the box blank being run. Such an apparatus is shown in H. D. Ward, Jr. Pat. No. 3,067,643 which utilizes gearing arrangements to produce registery and angle changing between the knives. These gearing arrangements such as shown in the Ward patent are extremely complex, massive, and expensive to produce. Such arrangements require many different gears and gear arrangements and as such require precision manufacturing. These systems, because they use so many gears, are extremely large and bulky. Consequently, the cost of such gear arrangements are extremely high and these costs are passed on to the customer. An apparatus which is relatively inexpensive, that utilizes relatively few gears, and is able to be confined to a relatively small area is needed. Since the above gearing arrangements are extremely complex, bulky, and expensive, it is still quite common not to use any type of gearing arrangement for changing the angle between the movable knife and the fixed knife. Thus, when it is desired to form the flaps on a box blank of different size than previously used, it is necessary to stop the operation and manually change the angle between the knives on each of the three slotting members. This method is not satisfactory since the operation of forming boxes must be stopped to change the knife angle which results in lost production time and because of human inaccuracies the angle between the knives on each slotter member may vary to a slight extent thus forming slots of different lengths on the trailing edge of the box blank which results in inferior boxes.

Another disadvantage in the Ward apparatus is that he uses hand-operated running registers to change the rotary position of the slotter member and to change the angle between the fixed and movable knives. Since the operator must take the time to adjust the registry by hand, it takes him away from his other duties and the master control panel that is used to indicate the status of other box making operations. In addition, Ward uses a control shaft external to the slotter heads and separate adjusting gears to change the knife angles on each slotter head. Thus, each adjusting gear must be individually adjusted by hand to the proper position to insure the same angle change is applied to each slotter member. Further, Ward uses the registry changing mechanism on one side of the slotter-scorer apparatus and the knife angle changing mechanism on the other side of the slotter-scorer apparatus. Thus, the machine operator must walk all the way around the machine each time he desires to make a change for each operation.

SUMMARY OF THE INVENTION

The present invention overcomes the complexity, massiveness, and expensiveness of prior art devices by utilizing harmonic drive principles in combination with a minimum number of gears. By utilizing harmonic drive principles, the registration and angle changing can be accomplished while the slotting operations continue in operation. Further it provides an automatic means to register one knife of the slotting member with the leading edge of the paperboard box blank passing thereunder and for changing the angel between the movable knife and the fixed knife to form slots of equal length when it is desired to run various size paperboard box blanks. By providing an automatic means to make the desired changes the operator can remain at the master control panel and make the changes while continually maintaining a constant watch on the other box making operations. In addition, it provides that both the registry mechanism and the angle changing mechanism be on the same side of the machine so if work needs to be done on them the operator need not waste time walking around the machine. In addition, this invention provides a splined control shaft internally mounted in the slotter member which eliminates the need for adjusting gears.

This invention therefore provides an apparatus for automatically changing the rotary position of a slotter member and for changing the relative position between a fixed knife and a movable knife on the slotter member comprising; a first rotatable shaft means having at least one of the slotter members secured thereto; the slotter member having a fixed knife means secured thereto and a movable knife means mounted thereon; a drive means; a first phase changing means connected between the first shaft means and the drive means for rotating the slotter member; a second rotatable shaft means spaced from the first shaft means; a linking means connected between the second shaft means and the movable knife means; a second phase changing means connected between the first shaft means and the second shaft means for rotating the movable knife means through the linking means; and a selectively operable remote control means for operating the first phase changing means to selectively change the rotary position of the slotter member forward and backward with respect to the drive means, the second phase changing means and the linking means maintaining the relative position of the fixed and movable knife means during operation of the first phase changing means, and for operating the second phase changing means independently of the drive means to selectively change the position of the movable knife means forward and backward relative to the position of the fixed knife means.

The above and further objects and novel features of the invention will appear more fully from the following detailed description when the same is read in connection with the accompanying drawings. It is to be expressly understood, however, that the drawings are not intended as a definition of the invention but are for the purpose of illustration only.

BRIEF DESCRIPTION OF THE DRAWINGS

In the drawings wherein like parts are marked alike:

FIG. 2 is a top view of a paperboard box blank showing slots of different lengths on the leading and trailing edge thereof which results from nonregistration between the leading edge of the box blank and the slotter member of FIG. 1;

FIG. 3 is a top view of the box blank of FIG. 2 showing slots of equal length formed on the leading and trailing edge thereof when the slotter member is in register with the leading edge of the box blank;

FIG. 4 is a top view of a box blank of greater size than the box blank shown in FIGS. 2 and 3 showing the orientation of the slots made by the slotter member of FIG. 1 when the angle between the slotting knives is that which produces proper slots in a box blank of the size shown in FIG. 3;

FIG. 5 is a top view of the box blank of FIG. 4 showing the slot orientation on the leading and trailing edge of the box blank when the angle between the knives of the slotter member of FIG. 1 has been changed to accommodate the larger size box blank.

DESCRIPTION OF THE PREFERRED EMBODIMENT

Figure 1:
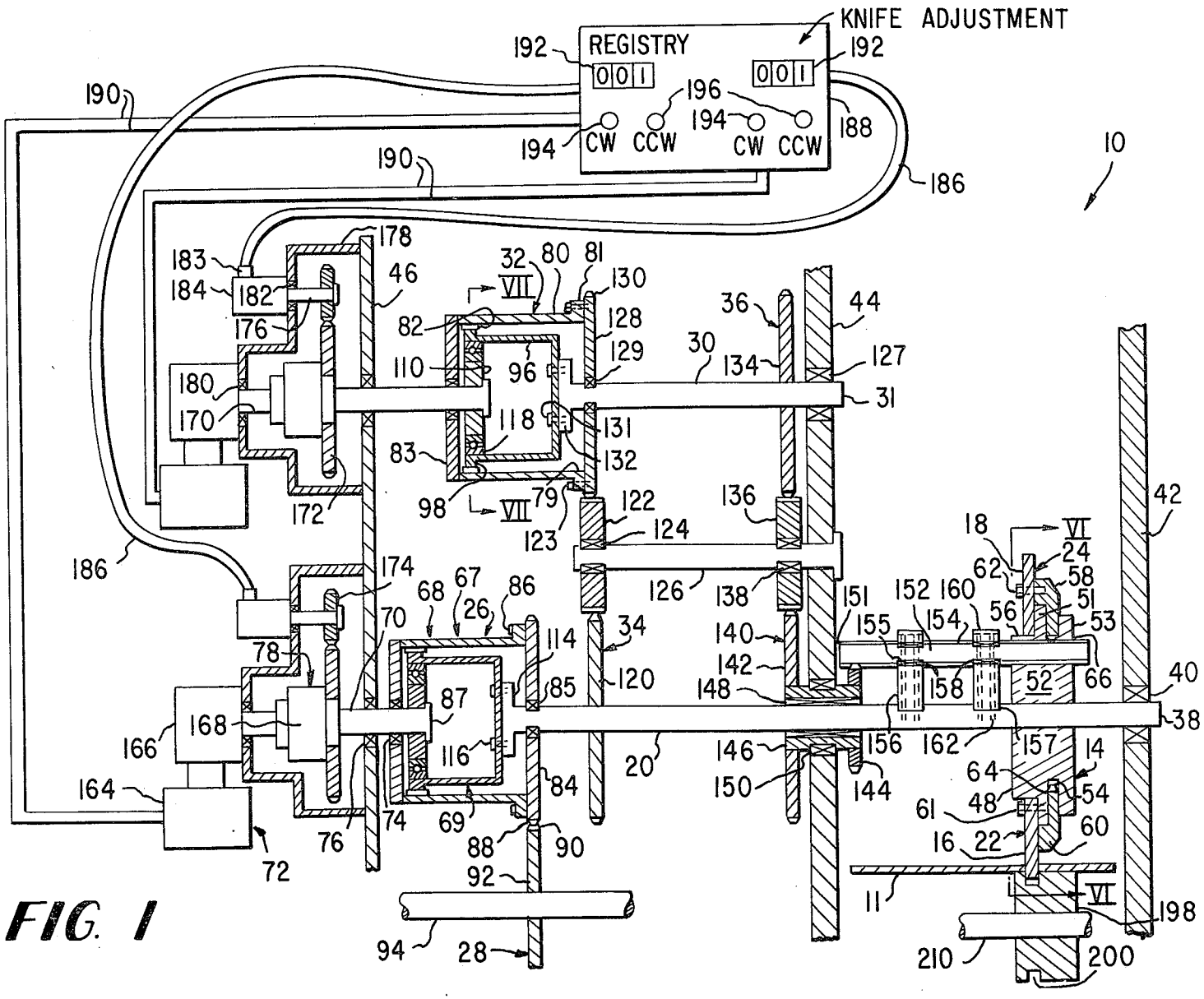
FIG. 1 is an end elevation in cross section of the apparatus of the present invention.

Box blanks manufactured by a conventional corrugator. The box blanks are then stacked and a stack of box blanks is placed on a feed table of a conventional slotter-scorer finishing machine. Conventionally, the slotter-scorer machine feeds each box blank at the predetermined speed through the slotter-scorer machine by a conventional driving mechanism. Ordinarily, each box blank is fed between three upper and lower slotting members for forming the flaps of which only one upper and lower slotting member is shown in FIG. 1 for simplicity. Knives penetrate blanks and pass through slots in the lower heads. The slotting members are spaced longitudinally along a shaft in accordance with the dimensions of the corrugated box blank to be formed. The slots made by the three upper and lower slotting members in the leading and trailing edges of the box blanks are of equal length and the length is determined by the size of the container to be formed. The slots define the flaps which form the top and bottom of the container. To form slots of equal length on the leading and trailing edges of the box blank it is mandatory that the slotting members be in exact registry with the leading edge and that the angle between the two slotting knives on the slotting members be adjusted to the correct angle when a box blank of different size is to be run. Conventionally, the fixed and movable knife means on the slotter member have a longer circumferential arc than the length of the slots formed in the box blank. Thus, the trailing edge of the lead knife must register with the point where the desired trailing edge of the front slot is to be formed and the front edge of the back knife must register with the point where the desired leading edge of the back slot is to be formed.

Referring to FIG. 1, generally, the apparatus, denoted generally by numeral 10, for changing the rotary position of a slotter member, denoted generally by numeral 14, and for changing the relative position between a fixed knife means, denoted generally by numeral 22, and a movable knife means, denoted generally by numeral 24, on slotter member 14 is mounted on three spaced frames 42, 44, and 46 which is associated with a conventional slotter-scorer machine (not shown). Apparatus 10 generally comprises a first shaft means 20 rotatably secured to frames 42 and 44 and having at least one slotter member 14 secured thereto. Slotter member 14 has a fixed knife means 22 fixably secured to slotter member 14 and a movable knife means 24 movably mounted on slotter member 14. A drive means, denoted generally by numeral 28 is used to drive a box blank 11 between slotter members 14 and 198 and to operate apparatus 10. A first phase changing means, denoted generally by numeral 26, is connected between first shaft means 20 and drive means 28 for rotating slotter member 14. A second shaft means 30 is spaced from first shaft means 20 and is rotatably secured to frame 44. A linking means, denoted generally by numeral 36, is connected between second shaft means 30 and movable knife means 24. A second phase changing means, denoted generally by numeral 32, is connected between first shaft means 20 and second shaft means 30 for rotating movable knife means 24 through linking means 36. A selectively operable remote control means 188 is electrically connected to first and second phase changing means 26 and 32 respectively for operating first phase changing means 26 to selectively change the rotary position of slotter member 14 forward and backward with respect to drive means 28, second phase changing means 32 and linking means 36 maintaining the relative position of fixed and movable knife means 22 and 24 during operation of first phase changing means 26, and for operating second phase changing means 32 independently of drive means 28 to selectively change the position of movable knife means 24 forward and backward relative to the position of fixed knife means 22.

It should be noted that in FIG. 1 the first phase changing means 26 and the second phase changing means 32 are substantially identical. Therefore, those parts that are identical between the first phase changing means 26 and the second phase changing means 32 are marked alike. For clarity in FIG. 1, the numbering of the parts that make up first phase changing means 26 and second phase changing means 32 are not duplicated between the two. However, where there is a difference between first phase changing means 26 and the second phase changing means 32 the individual parts are individually numbered.

Figures 6, 7:
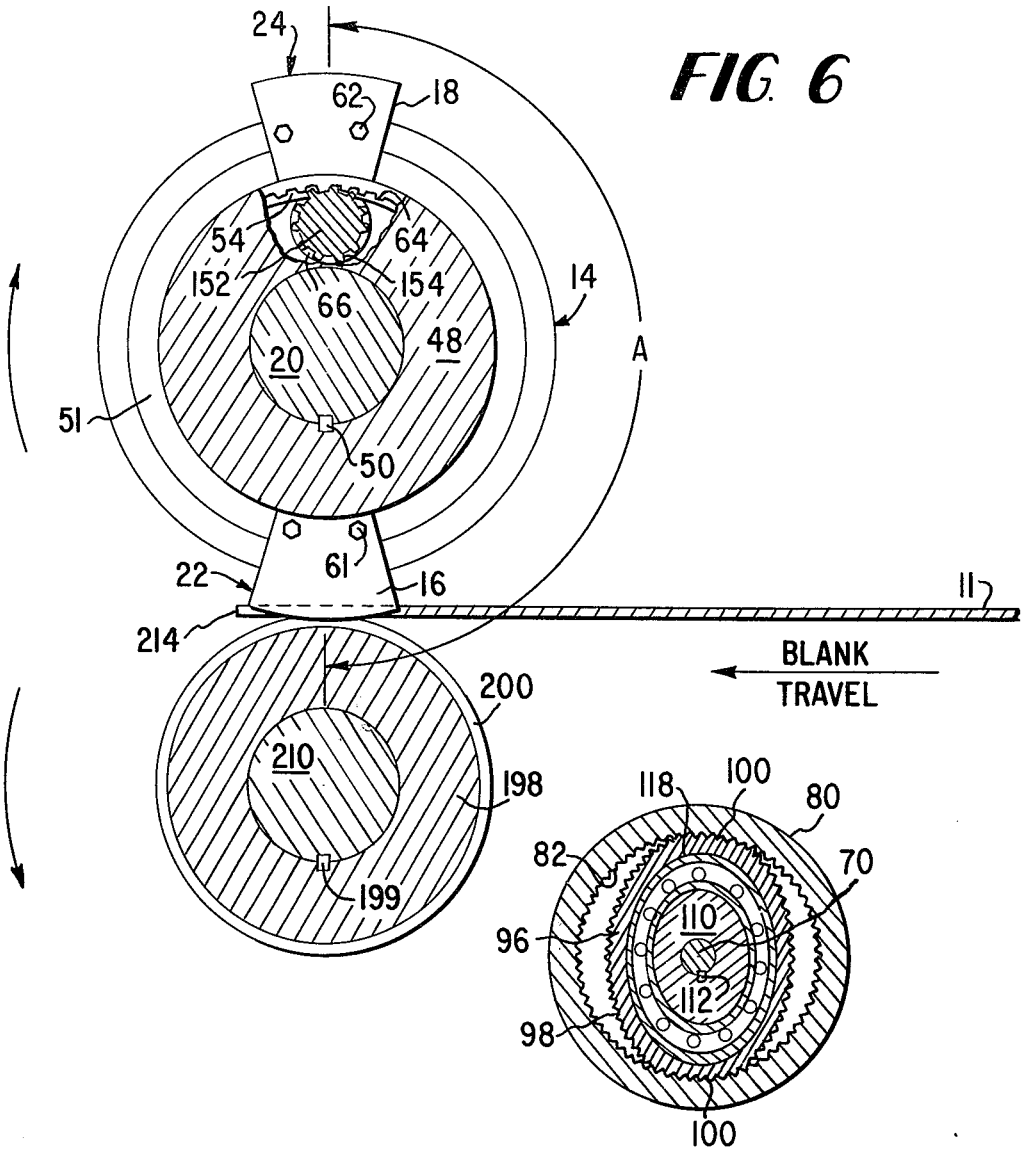
FIG. 6 is a cross sectional view of the slotter member of FIG. 1 taken along the lines VI—VI and showing the connection between the linking mechanism of FIG. 1 and the movable knife means on the slotter member.
FIG. 7 is an enlarged cross sectional view of the harmonic drive unit of FIG. 1 taken along the lines VII—VII showing the elliptical deformation of the flexible gear member.

More specifically, and referring to FIGS. 1, 6, and 7, apparatus 10 is mounted on three spaced frames 42, 44, and 46 which are associated with a conventional slotter-scorer machine (not shown) used in a conventional box making plant. Although three frame members are shown in FIG. 1, it should be understood that various arrangements and configurations may be used on which to mount apparatus 10 and still be within the scope of the invention.

One end of first shaft means 20 is rotatably mounted in a bearing 40 which is secured in side frame 42. First shaft 20 is secured in side frame 42 at a position spaced above the path of advance of a box blank 11 passing between side frame 42 and center frame 44, and extends transversely to the path of advance of box blank 11. First shaft means 20 passes through center frame 44 and is rotatably mounted therein (to be explained later) and terminates in a flanged end 144 at a point spaced from center frame 44.

Preferably, three slotter members 14 (only one shown in FIG. 1) are secured to first shaft means 20 between center frame 44 and side frame 42 in any conventional manner such as by key 50 (FIG. 6) so that when first shaft 20 rotates, slotter member 14 will also rotate. It should be understood that although three slotter members 14 are preferably secured to first shaft means 20, any number of slotter members may be secured thereon to produce the desired box configuration. Referring to FIGS. 1 and 6, slotter member 14 includes a fixed knife means 22 which is fixably secured to slotter member 14 and a movable knife means 24 movably mounted on slotter member 14. Preferably, slotter member 14 includes a rigid annular plate 48 commonly called a slotter head which is rigidly secured to first shaft means 20 by key 50 as previously described. Rigid annular plate 48 has a pair of radially extending and circumferentially extending spaced flanges 51 and 53 on its outer surface defining a space 54 between flanges 51 and 53. Annular plate 48 also includes a circumferentially extending shoulder portion 56, between flange 51 and side 52. Preferably, flange 51 extends radially outward a greater amount than outside flange 53. Rigid annular plate 48 further includes an axially extending opening 66 therethrough and is radially spaced between the center of rigid annular plate 48 and circumferentially extending shoulder 56. Preferably, axially extending opening 66 is located closer to shoulder portion 56 than to the center of rigid annular plate 48, as shown in FIGS. 1 and 6. Space 54 between flanges 51 and 53 radially extends inward to a point where it meets axially extending opening 66 as shown in FIG. 6.

Fixed knife means 22 includes a fixed slotter knife 16 which is seated on shoulder portion 56 and is rigidly secured to flange 51 by bolts 61. Movable knife means 24 includes an annular ring 58 having inwardly extending gear teeth 64 on its inner surface which fits within space 54 and gear teeth 64 radially extend inward into axially extending opening 66. Annular ring 58 further includes an axially extending flange 60 which slideably rests upon the top of flange 51. Thus, annular ring 58 is free to move about flange 51. Movable knife means 24 further includes a slotter knife 18 which is seated on shoulder 56 and is similar in construction to fixed slotter knife 16 and is secured to flange 60 of annular ring 58 by bolts 62. Thus, when annular ring 68 moves within space 54 between flanges 51 and 53 movable knife 18 will also move about the circumference of rigid annular plate 48.

Referring to FIG. 1, first phase changing means 26 includes a harmonic drive means, denoted generally by numeral 68, having an input means, denoted generally by numeral 67, driven by drive means 28 and an output means, denoted generally by numeral 69, connected to first shaft means 20; a shaft connector means 70 is connected to output means 69 of harmonic drive means 68 and is in substantial alignment with first shaft means 20; and a motor means, denoted generally by numeral 72, is connected to one end of shaft connector means 70 so that upon energization of motor means 72 shaft connector means 70 rotates energizing harmonic drive means 68 for changing the phase relationship between drive means 28 and first shaft means 20. Shaft connector means 70 extends through frame 46 and is rotatably mounted in a bearing 76 secured to frame 46. A similar harmonic drive as used in this invention is shown in Stewart U.S. Pat. No. 3,565,006.

Referring to FIGS. 1 and 7, input means 67 of harmonic drive means 68 includes an annular rotatable housing 80 being open at one end 79. Open end 79 has a radially outward extending flange 81. The other end of housing 80 is closed by an annular plate 83 which is secured thereto such as by welding. Annular housing 80 further includes inwardly extending gear teeth 82 circumferentially extending around the inner surface thereof. An annular input gear 84 is rotatably mounted on a bearing 85 secured to first shaft means 20 and is rigidly secured to flange 81 of annular housing 80 by bolts 86. Input gear 84 includes radially outward extending gear teeth 88 for meshing with external gear teeth 90 on a driving gear 92 of first drive means 28 thereby imparting rotary motion to housing member 80 upon rotation of driving gear 92. Driving gear 92 is rigidly secured such as by keying (not shown) to a shaft 94 which is connected to the conventional main drive train (not shown) of the slotter-scorer machine (not shown). The drive means 28 advances box blank 11 through the slotter-scorer apparatus, and at the same time drives slotter member 14.

Referring again to FIGS. 1 and 7, output means 69 of harmonic drive means 68 includes a circular flexible output gear 96 having a smaller diameter than the inner diameter of housing 80 and is nestled within housing 80. One end of flexible gear 96 is open and faces the closed end of housing 80 and the other end is closed and faces open end 79 of housing 80. The closed end of flexible gear 96 is secured to flanged end 114 of first shaft means 20 by bolts 116. The open end of flexible gear 96 includes radially extending gear teeth 98 circumferentially extending around the outer surface thereof. Shaft connector means 70 extends through annular plate 83 of housing member 80 and is rotatably mounted in a bearing 74 secured to annular plate 83. End 87 of shaft connector means 70 extends into the interior of flexible gear 96. An elliptical phase generator 110 is secured to end 87 of shaft connector means 70 such as by key 112 (FIG. 7). An elliptical roller bearing 118 is secured on the outer circumference of elliptical phase generator 110 such as by a press fit. Elliptical roller bearing 118 deforms flexible gear 96 into an elliptical configuration so that external gear teeth 98 of flexible gear 96 are in meshing engagement with internal gear teeth 82 of housing 80 at substantially two points 100 (FIG. 7) opposite the lobes of elliptical phase generator 110. The theory behind the operation of harmonic drive means 68 which changes the phase relationship between outer housing 80 and flexible gear 96 and consequently changes the phase relationship between driving gear 92 and slotter member 14 is fully described and explained in a brochure published by the Harmonic Drive Division of United Shoe Machinery Corp., Balch Street, Beverly, Massachusetts 01915, Form No. 5033 and will not be further described herein except where necessary in explaining the operation of apparatus 10.

Referring to FIG. 1, motor means 72 includes a conventional electrical motor 164 which is capable of rotating in either the clockwise or counter clockwise direction. Motor 164 is electrically connected to remote control panel 188 through a pair of electrical wires 190. A gear reducer mechanism 166 is connected between motor 164 and connector shaft 170. Gear reducer 166 rotates shaft 170, coupling 168, shaft connector means 70, and phase generator 110 at a slower rotational speed than motor 164 so that very small adjustments in registration can be made.

Referring to FIG. 1, first phase changing means 26 further includes a readout indicator means, denoted generally by numeral 78, which is connected between shaft connector means 70 and remote control panel 188 for indicating the difference in length required to bring slotter member 14 into register with the leading edge 214 (FIG. 3) of box blank 11. Readout indicator means 78 includes a conventional flexible gear coupling 168 connected between the end of shaft connector means 70 and motor means 72. Coupling 168 is connected to motor means 72 by a shaft 170. A large gear 172 is connected to coupling 168 such as by keying (not shown). A second smaller gear 174 is in meshing engagement with larger gear 172, and gear 174 is connected to a shaft 168 such as by keying (not shown). A housing 178 is secured around coupling 168, gear 172, and gear 174. Housing 178 is secured to frame 46 such as by welding. Shaft 170 from coupling 168 extends through housing 178 and is rotatably mounted in a bearing 180 secured to housing 178 and shaft 176 secured to gear 174 extends through housing 178 and is rotatably mounted in a bearing 182 secured to housing 178. A gear adaptor 184 is secured to housing 178 such as by bolting (not shown) so shaft 176 extends therethrough into a gearing arrangement for imparting a 90 degree change in direction through an adaptor 183. A flexible shaft 168 is connected at one end to adaptor 183 and is connected at the other end to a digital read out odometer 192 which is mounted on the registry side of remote control panel 188. The operation and function of control panel 188 will be described in detail later.

Referring to FIG. 1, second shaft means 30 is rotatably mounted at end 31 in a bearing 127 secured in frame 44. Second shaft means 30 axially extends from frame 44 parallel to first shaft means 20 and terminates in a radially extending flange 132 at the other end.

Referring to FIGS. 1 and 7, second phase changing means 32 is substantially identical to first phase changing means 26 and includes a primary input means 34 driven by first shaft means 34; a harmonic drive means 68 having an input means 67 driven by primary input means 34 and an output means 69 connected to second shaft means 30; a shaft connector means 70 connected to output means 69 of harmonic drive means 68 in substantial alignment with second shaft 30; and a motor means 72 connected to shaft connector means 70 so that upon energization of motor means 72 shaft connector means 70 rotates for energizing output means 69 of harmonic drive means 68 for changing the angular relationship between fixed and movable knife means 22 and 24 respectively (FIG. 6). Shaft connector means 70 extends through frame 46 and is rotatably mounted in bearing 76 secured to frame 46. It further includes a readout indicator means 78 which is connected through a flexible shaft 186 to an odometer type digital readout 192 on the knife adjustment side of remote control panel 188. In addition, motor 164 is electrically connected to remote control panel 188 by a pair of electrical wires 190. Since second phase changing means 32 is substantially identical to first phase changing means 26, second phase changing means 32 will not be further described except where differences occur.

The first difference between first phase changing means 26 and second phase changing means 32 is that second phase changing means includes primary input means 34. Referring to FIG. 1, primary input means 34 includes a first gear 120 axially spaced from input gear 84 and is rigidly secured to first shaft means 20 such as by keying (not shown). A second gear 122 is in meshing engagement with first gear 120 and is rotatably mounted in a bearing 124 secured to a shaft 126. Shaft 126 is rigidly secured to frame 44 and extends parallel to first shaft means 20 and second shaft means 30.

Harmonic drive means 68 of second phase changing means 32 is identical to harmonic drive means 68 of first phase changing means 26 except that harmonic drive means 68 includes an annular input gear 128 instead of input gear 84 as shown for the first phase changing means 26. Input gear 128 is rotatably mounted in a bearing 129 secured to second shaft means 30 and is rigidly secured to flange 81 of housing 80 of harmonic drive means 68 by bolts 123. Input gear 128 includes outwardly extending gear teeth 130 which are in meshing engagement with second gear 122 of primary input means 34. In addition, flexible gear 96 of harmonic drive means 68 is secured to flange 132 of second shaft means 30 by bolts 131. Thus, when first shaft means 20 is rotated, second shaft means 30 is also rotated through primary input means 34 and harmonic drive means 68 of second phase changing means 32.

Referring to FIG. 1, linking means 36 includes a first gear 134 axially spaced from gear 128 and rigidly secured to second shaft means 30 such as by keying (not shown). A second gear 136 is in meshing engagement with first gear 134 and is rotatably mounted in a bearing 138 secured to shaft 126. A third gear means, denoted generally by numeral 140, is rotatably mounted on first shaft means 20 by a bearing 148. Third gear means 140 is preferably a compound gear which includes an input gear 142 in meshing engagement with second gear 136; an output gear 144 axially spaced from input gear 142; and a sleeve means 146 rigidly connected between input gear 142 and output gear 144 such as by keying (not shown) or by a press fit. Sleeve 146 is rotatably mounted on first shaft means 20 by gearing 148 and is rotatably mounted in a bearing 150 secured in frame 44 so that input gear 142 is on one side of frame 44 and output gear is on the other side of frame 44.

Referring now to FIGS. 1 and 6, linking means 36 further includes a splined shaft means 152 having external gear teeth 154 and having an axial length sufficient to span between output gear 144 and the desired number of slotter members 14. In addition, the splined shaft 152 permits the slotter heads 14 to be positioned along shaft 20 to provide the desired distances between the slots in the box blank 11 by merely unlocking the heads. Splined shaft means 152 is radially spaced from and extends parallel to first shaft means 20 and transversely to the path of advance of box blank 11. One end 151 of splined shaft means 152 is in meshing engagement with output gear 144 and the remaining length of splined shaft means 152 extends through opening 66 in each slotter member 14, so that spline teeth 154 of splined shaft means 152 is in meshing engagement with the internal extending gear teeth 64 of annular ring 58 of movable knife means 24. Splined shaft means 152 is rotatably secured to first shaft means 20 by a plurality of platforms 156 which are seated in notched portions 157 of first shaft means 20. Platform 156 radially extends outwardly so that a narrowed portion 155 on splined shaft means 152 rests within a cut out portion in the top of platform 156. The top portion of platform 156 contains a half bushing 158 so that narrowed portion 155 of spline gear 152 may rotate about bushing 158. A top 160 also containing a cut out portion and a half bushing 158 is secured to platform 156 over notched portion 155 of splined shaft means 152 by bolts 162 which extend from top 160 through platform 156 and into first shaft means 20. Thus, splined shaft means 152 is secured to first shaft means 20 so that when first shaft means 20 rotates splined shaft means 152 will also rotate with first shaft means 20, however, because splined shaft means 152 is rotatably mounted in platform 156, splined shaft means 152 is also able to rotate about its own axis. Therefore, second phase changing means 32 is connected to movable knife means 24 through linking means 36. In particular, splined gear teeth 154 of splined shaft means 152 are in meshing engagement with gear teeth 64 of annular ring 58 of movable knife means 24.

OPERATION

Referring to FIGS. 1, 2, 3, 4, 5, 6, and 7, when it is desired to form the flaps 220 (see FIGS. 2, 3, 4, and 5) on a box blank 11, the operator places a stack of box blanks on a conventional feed table of a conventional slotter-scorer machine (not shown). The operator energizes the main drive train of the slotter-scorer apparatus which operates a conveyor system from the feed table through the slotter-scorer machine at a predetermined speed. The feed table feeds a single box blank 11 at a time from the stack so that a box blank 11 is conveyed through the slotter-scorer machine between frame 42 and frame 44. In addition, the main drive train also energizes drive means 28 which rotates shaft 94 and drive gear 92. Box blank 11 travels beneath first shaft means 20 and between upper and lower slotter members 14 and 198 (FIGS. 1 and 6). Lower slotter members 198 are rigidly secured to a shaft 210 such as by key 199 and is connected to the main drive train of the slotter-scorer machine. Lower slotter member 198 and shaft 210 are parallel to and in alignment below first shaft means 20 and upper slotter member 14. Lower slotter member 198 is in alignment with knives 16 and 18 on slotter member 14. In addition, lower slotter member 198 contains a circumferential extending slot 200 in its outer periphery for receiving of knives 16 and 18 as they pass through box blank 11.

For illustration purposes only, box blank 11 will be depicted as traveling in the direction shown by the arrow in FIGS. 2, 3, 4 and 5 and knife 16 of fixed knife means 22 will be depicted as making slots 212 on the leading edge 214 of box blank 11 and knife 18 of movable knife means 24 will be depicted as making slots 216 in the trailing edge of box blank 11. However, it should be understood that either knives 16 or 18 can make slots 212 or 216. As box blank 11 travels between upper and lower slotter members 14 and 198, leading knife 16 forms a slot 212 in the leading edge 214 of box blank 11 and trailing knife 18 forms a slot 216 in the trailing edge 218 of box blank 11 as shown in FIGS. 1, 3, and 5

Three phases in the operation of apparatus 10 will now be described. The first operation will be the normal running of a box blank 11 though the slotter-scorer machine when registry of slotter member 14 is not necessary and when a knife adjustment between the fixed knife means 22 and the movable knife means 24 is not necessary. In the first operation, box blank 11 will be formed with flaps 220 as shown in FIGS. 3 and 5. The second operation will be where knife 16 of slotter member 14 is out of registry with the leading edge of box blank 11 as shown in FIG. 2. The second operation will describe the manner in which trailing edge of leading knife 16 of slotter member 14 is brought into register with the point where the desired trailing edge of slot 212 is to be formed and where the front edge of knife 18 must register with the point where the desired leading edge of slot 216 is to be formed so that a box blank 11 of proper configuration is formed as shown in FIG. 3. The third operation will be the operation of changing the angle A (FIG. 6) between the fixed knife means 22 and the movable knife means 24 when a box blank of larger or smaller size is desired to be run such as shown in FIG. 4 to form a box blank 11 of proper slot configuration as shown in FIG. 5.

When using harmonic drive means such as that used with apparatus 10 it is customary to have the flexible gear contain a less number of gear teeth than the number of gear teeth surrounding the inner periphery of the annular housing. The flexible gear will therefore rotate at a slightly faster angular velocity than the housing. To insure that slotter member 14 rotates at the same angular velocity as slotter member 198 and first drive means 28 and to insure proper registration during normal operation, the number of gear teeth in each of the gears throughout apparatus 10 must be properly varied.

For illustration purposes, the various gears used in apparatus 10 will be described as having a specific number of gear teeth to illustrate the tooth configuration and relationship between the various gears for continuous proper registration. It should be understood, however, that although a specific number of gear teeth is illustrated in the description of the operation any tooth configuration of the various gears may be used as long as in the end result slotter member 14 is rotating at the same speed as slotter member 198.

During normal operation of the slotter scorer machine in which apparatus 10 is used, phase generator 110 of first phase changing means 26 and second phase changing means 32 are held stationery so that the lobes of phase generator 110 maintain the same orientation with respect to annular housing 80. Phase generator 110 is held stationery by any conventional braking mechanism in gear reducer 166 so that when motor 164 is de-energized, gear reducer 166 will be braked thereby preventing rotation of shaft 170, coupling 168, shaft connector means 70, and consequently phase generator 110 and elliptical roller bearing 118. When phase generator 110 is held stationary, flexible gear 96 rotates about roller bearing 118 when annular housing 80 is rotated due to the meshing engagement of gear teeth 98 and 82 respectively at the two contact points 100.

Referring to FIGS. 1, 6 and 7, during the normal operation of the slotter-scorer machine, shaft 94 is rotated by the main drive train of the slotter-scorer machine and is driven at the desired machine speed. Shaft 94 rotates drive gear 92 which for illustration purposes will contain 96 gear teeth 90. The 96 gear teeth 90 of drive gear 92 are in meshing engagement with gear teeth 88 of input gear 84. Input gear 84 contains 97 gear teeth so that input gear 84 will rotate at a slightly slower angular velocity than drive gear 92. Input gear 84 is rotatably mounted on bearing 85 secured to first shaft means 20 so that input gear 84 will rotate about first shaft means 20. Input gear 84 rotates annular housing 80 of harmonic drive means 68 of first phase changing means 26. Outer annular housing 80 also contains 97 gear teeth 82 which are in meshing engagement with gear teeth 98 of flexible gear 96 having 96 gear teeth at essentially two points 100. Thus annular housing 80 which is in meshing engagement with gear teeth 98 of flexible gear 96 will rotate flexible gear 96 at a slightly faster angular velocity than the angular velocity of annular housing 80. Since flexible gear 96 contains 96 gear teeth and drive gear 92 also contains 96 gear teeth, flexible gear 96 and drive gear 92 will rotate at the same angular velocity. Thus, first shaft means 20 will also rotate at the same angular velocity as drive gear 92 since it is connected to flexible gear 96 and since slotter member 14 is rigidly secured to first shaft means 20 slotter member 14 will also rotate at the same angular velocity as first drive gear 92 and slotter member 198.

Since movable knife means 24 is rotatably mounted on slotter member 14, movable knife means 24 must also rotate at the same angular velocity as fixed knife means 22 to maintain angle A between fixed knife means 22 and movable knife means 24. First gear 120 of primary input means 34 is rigidly secured to first shaft means 20 and thus rotates at the same angular velocity as first shaft means 20. First gear 120 contains 96 gear teeth which is the same as first drive gear 92. Second gear 122 which is rotatably mounted on shaft 126 is merely an idler gear and it doesn't matter how many teeth it has, the ratio is determined by the number of teeth of gear 120 and gear 128. Second gear 122 is in meshing engagement with input gear 128 which is rotatably mounted on bearing 129 secured to second shaft means 30 and is connected to outer housing 80 of harmonic drive means 26 of second phase changing means 32. Input gear 128 contains 97 gear teeth 130 so that it rotates at a slightly slower angular velocity than gear 120. Housing 80 of harmonic drive means 26 of second phase changing means 32 has 97 gear teeth 82 on its inner periphery which are in meshing engagement with 96 gear teeth 98 on flexible gear 96 at substantially two contact points 100. Since flexible gear 96 is rigidly connected by bolts 131 to second shaft means 30, flexible gear 96 which has 96 gear teeth will rotate second shaft means 30 at a slightly faster angular velocity than housing 80 and since proper gear teeth configuration has been maintained, second shaft means 30 will rotate at the same angular velocity as first shaft means 20.

First gear 134 of linking means 36 contains 96 gear teeth and is rigidly connected to first shaft means 30. Second gear 136 is an idler gear and it doesn't matter how many teeth it has, the ratio is determined by the number of teeth of gear 134 and 142 and is rotatably mounted on bearing 138 secured to shaft 126 and is in meshing engagement with first gear 134. Input gear 142 also contains 96 gear teeth and is in meshing engagement with second gear 136. Since third gear means 140 is a compound gear and is rotatably mounted on first shaft means 20 by bearing 148 and rotatably mounted in bearing 150 secured to frame 44, input gear 142, sleeve 146, and first shaft means 20 are rotating at the same angular velocity. Therefore sleeve 146 is not rotating about first shaft means 20. Output gear 144 which is secured to sleeve 146 also contains 96 gear teeth and is rotating at the same angular velocity as first shaft means 20. In order to insure that movable knife means 24 does not move relative to fixed knife means 22, splined gear means 152 will contain 18 gear teeth 154 which are in meshing engagement with the 96 gear teeth of output gear 144 and with gear teeth 64 of annular ring 58 on which knife 18 is mounted. In this configuration, annular ring 58 will contain 132 gear teeth 64. Since third gear means 140 is not moving relative to first shaft means 20, no rotational movement of splined gear means 152 about its own axis will occur. However, splined gear means 152 will rotate with first shaft means 20 at the same angular velocity as first shaft means 20 since it is secured to first shaft means 20 by platforms 156. Consequently, movable knife means 24 will have the same angular velocity about the axis of shaft 20 as fixed knife means 22 and angle A (FIG. 6) will be maintained.

Referring to FIGS. 2 and 3, when it is desired to change the registry between knife 16 of slotter member 14 and leading edge 214 of box blank 11 the following operation is run. As shown in FIG. 2, slotting member 14 will be out of registry with the leading edge 214 of box blank 11 when slot 212 in the leading edge 214 of box blank 11 has a different length X as compared to length X′ of slot 216 in the trailing edge 218 of box blank 11. Although as shown in FIG. 2 slot 212 in the leading edge 214 is of a shorter length than slot 216 in the trailing edge 218, it should be understood that the length X of slot 212 may be longer than the length X′ of slot 216. For illustration purposes only, slot 212 is shown at a shorter length X than slot 216. When registry is needed, the operator measures the difference between the length X of slot 212 and the length X′ of slot 216. The difference in slot length X and X′ divided by two is the amount that slotter member 14 must be retarded or speeded up relative to drive gear 92 which corresponds to blank velocity to bring knife 16 into registry with leading edge 214. The angular velocity of slotter member 14 must be temporarily changed while maintaining the proper angular velocity of slotter member 198 to bring the rotary position of knife 16 into registry with edge 214 of box blank 11. To termorarily change the angular velocity of slotter member 14 the operator activates motor 164 of motor means 72 of first phase changing means 26 by pushing starter buttons 194 or 196 on the registry side of control panel 188. For illustration purposes only, it will be assumed that housing member 80 of harmonic drive means 68 rotates in the clockwise direction looking from left to right in FIG. 1. If slot length 212 is to be increased, slotter member 14 must be retarded so the operator depresses the counter clockwise button 196 on the registry side of control panel 188 which activates motor 164 in the counterclockwise direction; however, if the length of slot 212 is to be decreased, the clockwise button 194 on the registry side of control panel 188 will be depressed which rotates motor 164 in a clockwise direction. As shown in FIG. 2 the slot length X of slot 212 needs to be increased, therefore the operator will depress the counter clockwise button 196 on the registry side of control panel 188. This activates motor 164 in the counter clockwise direction which rotates gear reducer 166 in the counter clockwise direction. Reducer 166 rotates shaft 170, coupling 168, and shaft connector means 70, in the counter clockwise direction at a reduced angular velocity so that small changes in length can be measured. Referring to FIG. 7, since shaft connector means 70 is rotating in the counter clockwise direction and phase generator 110 is rigidly secured to shaft connector means 70, phase generator 110, and roller bearing 118 secured to phase generator 110 will rotate counter clockwise. This counter clockwise rotation of phase generator 110 will deflect flexible gear 96 so that the two points of contact 100 between gear teeth 98 of flexible gear 96 and gear teeth 82 of outer housing 80 will move counter clockwise to give a different point of orientation. Thus, it can be seen that flexible gear 96 is rotating in the clockwise direction at a lesser angular velocity than housing 80 during the counter clockwise rotation of phase generator 110. Since flexible gear 96 is connected to slotter member 14 through first shaft means 20, slotter member 14 will be rotating clockwise at a slower angular velocity than slotter member 198 and consequently box blank 11. This slower clockwise angular velocity of slotter member 14 will bring more of knife 16 in contact with box blank 11 which will increase the length of slot 212.

To determine when the correct slot length is reached to make the length X of slot 212 in the leading edge 214 the same length as X′ of slot 216 on the trailing edge 218 of box blank 11, the operator reads the difference in length X and X′ divided by two on a digital read out odometer window 192 on the registry side of control panel 188. Since shaft connector means 70 and shaft 170 are connected to coupling 168, coupling 168 is rotated counter clockwise at the same angular velocity as phase generator 110. Gear 172 is rotated by coupling 168 and gear 174 which is in meshing engagement with second gear 172 rotates shaft 176 which rotates gear adaptor 184. Flexible shaft 186 is connected between adaptor 183 and a convention digital readout odometer 192 on the registry side of control panel 188. Thus the rotation of flexible shaft 186 rotates digital readout odometer 192 so that the counter clockwise rotational distance moved by phase generator 110 is read in the window of the odometer readout 192. When the difference in length between X and X′ divided by two is shown in the odometer window 192 knife 16 will be in registry with the leading edge 214 and the operator then deactivates motor 164 which sets the brake in gear reducer 166 which stops further counter clockwise rotation of phase generator 110. With phase generator 110 in its stationery position, first shaft means 20 and, consequently slotter member 14, will again be rotating at the same angular velocity as first drive gear 92 and slotter member 198. Thus, box blank 11 as shown in FIG. 3 will once again have slots of equal length in the leading and trailing edges 214 and 216.

When the operator desires to process box blanks of different size, as shown in FIGS. 4 and 5, the angle A (FIG. 6) between the fixed knife means 22 and the movable knife means 24 must be changed to increase or decrease the arc length subtended by angle A to increase or decrease the distance between slots 212 and 216. This is to insure that proper slot orientation is maintained to form proper flaps 220 on the new box blanks. For illustration purposes, as shown in FIGS. 4 and 5, a box blank 11 of larger size is to be run. However, it should be understood that either a smaller box blank or a larger box blank may be run and if a smaller box blank 11 is to be run the angle A between the fixed knife means 22 and the movable knife means 24 will be decreased to decrease the arc length while as shown in FIGS. 4 and 5 if a larger box blank 11 is to be run angle A must be increased to increase the arc length to increase the distance between slots 212 and 216.

Referring to FIGS. 4 and 5, to change angle A and consequently the arc length subtended by angle A the operator measures the distance Y between slots 212 on leading edge 214 of box blank 11 and slot 216 on trailing edge 218 of box blank 11. Then the operator determines the distance Y′ between slot 212 and slot 216 that is necessary to produce slots of equal length and equal configuration on the larger box blank 11 to be run. The operator then determines the difference between distance Y and Y′ and this difference is the increase in arc length subtended by angle A that is needed to give proper slot orientation to the larger box blank 11. The difference in arc length subtended by angle A is read on control panel 188 through the odometer type digital readout 192 on the knife adjustment side of control panel 188. The operator can thereby determine when the correct increase in arc length subtended by angle A has been reached.

Assuming for illustration purposes only that slotter member 14 as shown in FIGS. 1 and 6 is rotating in the clockwise direction and that the box blank 11 to be run is of larger size than previously run then the arc length subtended by angle A must be increased. Thus, relative to fixed knife means 22, movable knife means 24 must temporarily be rotated counterclockwise. To increase angle A the operator depresses the clockwise button 194 on the knife adjustment side of control panel 188. This activates motor 164 of second phase changing means 32 in the clockwise direction. Motor 164 rotates gear reducer 166, shaft 170, coupling 168, shaft connector means 70, and phase generator 110 in the clockwise direction.

Referring to FIG. 1, the clockwise rotation of phase generator 110 rotates roller bearing 118 clockwise deforming flexible gear 96 and rotating the two points of contact 100 in the clockwise direction. This clockwise deflection of flexible gear 96 will increase the angular velocity of flexible gear 96 in the clockwise direction. Since the angular velocity of flexible gear 96 is increased while the angular velocity of annular housing 80 stays the same as first shaft means 20, second shaft means 30 will rotate at a greater angular velocity than first shaft means 20. This increased angular velocity of second shaft means 30 in the clockwise direction is imparted to first gear 134 of linking means 36. The clockwise rotation of first gear 134 rotates second gear 136 counter clockwise which rotates input gear 142, sleeve 146, and output gear 144 clockwise. Thus, compound gear 140 is rotating in the clockwise direction with an angular velocity greater than the angular velocity of first shaft means 20. Since sleeve 146 and consequently output gear 144 are rotating clockwise at a greater angular velocity than the clockwise angular velocity of first shaft means 20, splined shaft means 152 in meshing engagement with output gear 144 will rotate counter clockwise about its own axis as first shaft means 20 rotates splined shaft means 152 about the axis of first shaft means 20 since splined shaft means 152 is secured to first shaft means 20 by platforms 156. This counter clockwise rotation of splined shaft means 152 about its own axis is imparted through its gears 154 to teeth 64 of angular ring 58, and annular ring 58 will rotate in the clockwise direction at an angular velocity that is less than the angular velocity of fixed knife means 22. Thus, relative to fixed knife means 22, movable knife means 24 is rotating counter clockwise. This decrease in angular velocity of movable knife means 24 will cause angle A between fixed knife means 22 and movable knife means 24 to increase. Since angle A is increased, the arc length subtended by angle A is also increased.

Referring to FIGS. 1, 4, and 5, the difference between length Y and length Y′ is read on the digital odometer readout window 192 on the knife adjustment side of control panel 188. The operation of the digital odometer readout indicator 192 on the knife adjustment side of control panel 188 is the same as that described for the registry side of control panel 188 will not be further described. When the correct arc length is read in window 192 the operator de-energizes motor 164 which stops and brakes gear reducer 166 which stops any further clockwise rotation of phase generator 110. Thus, the new position of the two contact points 100 opposite the cam lobes of phase generator 110 are in a new position clockwise from the position that they were before. Once phase generator 110 stops rotating, apparatus 10 will be running in its normal operation wherein second shaft means 30 and first shaft means 20 are again rotating at the same angular velocity. When this occurs there will be no relative movement between fixed knife means 22 and movable knife means 24 thereby maintaining the correct angle A between them. When this occurs, box blank 11 as shown in FIG. 5 will have the correct slot orientation.

The operation for decreasing angle A is exactly the same as the operational described for increasing angle A except that the counter clockwise button 196 on the knife adjustment side of control panel 188 is depressed which operates everything in the opposite direction.

The foregoing has presented a novel apparatus used in conjunction with a conventional slotter-scorer machine for forming the flaps on corrugated box blanks so that the box blanks may be formed into boxes. The apparatus to be used presents a novel automatic means of changing the rotary position of the slotter member in relationship to the leading edge of the box blank passing thereunder to insure that the slots formed on the leading edge of the box blank are the same length as the slots formed in the trailing edge of the box blank. In addition, this apparatus presents a novel automatic means of changing the relative position between the fixed and movable knives on the slotter member to form the proper slot orientation when the size of the box blank being run is changed. Both operations are performed from a remote control panel without having to stop the operation of the machine or take the operators attention away from other operations in the box making operation. The complexity of the operation has been substantially reduced by the use of harmonic drive devices to place the knives in registry with the leading edge of the box blank and to change the angle between the fixed and movable knives. This allows the use of a minimum amount of gears between the harmonic drive devices and the slotter member. In addition, by using harmonic drive devices and a minimum amount of gearing, the expense of manufacturing such an apparatus is kept to a minimum. Further, the use of harmonic drive devices associated with the minimum amount of gearing allows for an overall smaller package as compared to prior art devices.

Accordingly, the invention having been described in its best embodiment and mode of operation that which is desired to be claimed by Letters Patent is:

1. Apparatus for changing the rotary position of a slotter member and for changing the relative position of fixed and movable knife means on said slotter member, comprising:

a first rotatable shaft means having at least one of said slotter members secured thereto;

said slotter member having a fixed knife means secured thereto and a movable knife means mounted thereon;

a drive means;

a first phase changing means connected between said first shaft means and said drive means for rotating said slotter member;

a second rotatable shaft means spaced from said first shaft means;

a linking means connected between said second shaft means and said movable knife means;

a second phase changing means connected between said first shaft means and said movable knife means through said linking means; and a selectively operable remote control means for:

1. operating said first phase changing means to selectively change the rotary position of said slotter member forward and backward with respect to said drive means said second phase changing means and said linking means maintaining the relative position of said fixed and movable knife means during operation of said first phase changing means, and for

2. operating said second phase changing means independently of said drive means to selectively change the position of said movable knife means forward and backward relative to the position of said fixed knife means.

2. The apparatus of claim 1 wherein said movable knife means includes:

a movable annular ring means mounted on said slotter member;

a slotter knife rigidly secured to said annular ring means and extending beyond the outer circumference of said annular ring means; and said annular ring means having inwardly extending gear teeth on its inner surface for rotation by a splined shaft means of said linking means.

3. The apparatus of claim 1 wherein said first phase changing means includes:

a harmonic drive means having an input means driven by said drive means and an output means connected to said first shaft means;

a shaft connector means connected to said output means and in substantial axial alignment with said first shaft means; and a motor means connected to said shaft connector means so that upon energization of said motor means said shaft connector means rotates for energizing said output means to change the rotary position between said drive means and said first shaft means.

4. The apparatus of claim 3 further including a readout indicator means connected between said shaft connector means and said remote control means for indicating the rotary position of said slotter member in relation to the position of said drive means.

5. The apparatus of claim 3 wherein said input means of said harmonic drive means includes:

an annular rotatable housing member having internal gear teeth; and an annular input gear secured to said housing member and having outwardly extending gear teeth for meshing with outwardly extending gear teeth on a driving gear of said drive means, thereby rotating said housing member upon rotation of said driving gear.

6. The apparatus of claim 5 wherein said output means of said harmonic drive means includes:

a flexible output gear housed within said housing member and secured to said first shaft means;

said flexible output gear being of smaller diameter than said housing member and having outwardly extending gear teeth;

an elliptical phase generator connected to said shaft connector means and housed within said flexible gear deforming said flexible gear to an elliptical shape so that said outwardly extending gear teeth are in meshing engagement with said internal gear teeth at two contact points; and said elliptical phase generator adapted to deform said flexible gear forward and backward with respect to said housing member upon energization of said first phase changing means for changing the relative circumferential position of said two contact points, thereby changing the phase relationship between said flexible gear and said housing member.

7. The apparatus of claim 1 wherein said second phase changing means includes:

a primary input means driven by said first shaft means;

a harmonic drive means having a secondary input means driven by said primary input means and an output means connected to said second shaft means;

a shaft connector means connected to said output means and in substantial alignment with said second shaft means; and a motor means connected to said shaft connector means so that upon energization of said motor means said shaft connector means rotates for energizing said output means to change the angular relationship between said fixed and movable knife means.

8. The apparatus of claim 7 wherein said primary input means includes:

a first gear rigidly connected to said first shaft means;

a second gear in meshing engagement with said first gear and said secondary input means of said harmonic drive means; and said second gear rotatably mounted on a shaft.

9. The apparatus of claim 7 further including a readout indicator means connected between said shaft connector means and said remote control means for indicating the angular distance between said fixed and movable knife means.

10. The apparatus of claim 7 wherein said secondary input means of said harmonic drive means includes:

an annular rotatable housing member having internal gear teeth; and an annular input gear secured to said housing member and having outwardly extending gear teeth for meshing with a gear of said primary input means, thereby rotating said housing member upon rotation of said primary input means.

11. The apparatus of claim 10 wherein said output means of said harmonic drive means includes:

a flexible output gear housed within said housing member and secured to said second shaft means;

said flexible output gear being of smaller diameter than said housing member and having outwardly extending gear teeth;

an elliptical phase generator connected to said shaft connector and housed within said flexible gear deforming said flexible gear to an elliptical shape so that said outwardly extending gear teeth are in meshing engagement with said internal gear teeth at two contact points; and said elliptical phase generator adapted to deform said flexible gear forward and backward with respect to said housing member upon energization of said second phase changing means for changing the relative circumferential position of said two contact points, thereby changing the phase relationship between said flexible gear and said housing member.

12. The apparatus of claim 1 wherein said linking means includes;

a first gear connected to said second shaft means;

a second gear in meshing engagement with said first gear;

said second gear rotatably mounted on a shaft;

a third gear means rotatably mounted on said first shaft means;

said third gear means including, an input gear in meshing engagement with said second gear, an output gear axially spaced from said input gear, and a sleeve means secured between said input and output gears;

a splined shaft means rotatably secured to said first shaft means; and said splined shaft means having one end in meshing engagement with said output gear and having the other end in meshing engagement with gear teeth on said movable knife means, whereby rotational motion is transferred from said second shaft means to said movable knife means.

13. The apparatus of claim 12 wherein said movable knife means includes:

a movable annular ring means mounted on said slotter member;

a slotter knife rigidly secured to said annular ring means and extending beyond the outer circumference of said annular ring means; and said annular ring means having inwardly extending gear teeth on its inner surface in meshing engagement with the gear teeth on said splined shaft means.

14. An apparatus for registering a rotary slotter member with a corrugated box blank traveling through a box blank slotter-scorer machine and for changing the angle between a fixed knife means and a movable knife means on said slotter member to accommodate different size box blanks during operation of said machine without having to interupt operations, comprising:

a first rotatable shaft means spaced above the path of advance of said box blank traveling through said slotter-scorer machine;

said first shaft means rotatably secured to a frame means of said slotter-scorer machine and having at least one of said slotter members secured thereto for rotation above said box blank;

said slotter member having a fixed knife means secured to said slotter member and a movable knife means rotatably mounted on said slotter member;

a registry changing means connected between said first shaft means and a drive means for rotating said slotter member and for changing the phase relationship of said slotter member to the leading edge of said traveling box blank;

said drive means advancing said box blank through said slotter-scorer machine and connected to an input portion of said registry changing means;

a second rotatable shaft means spaced above said first shaft means and rotatably connected to said frame means;

a linking means connected between said second shaft means and said movable knife means;

a phase changing means connected between said first shaft means and said second shaft means for rotating said movable knife means; and a selectively operable remote control means for:

1. operating said registry changing means to selectively change the rotary position of said fixed and movable knife means with respect to said drive means, said phase changing means and said linking means maintaining the relative position of said fixed and movable knife means during operation of said registry changing means, and for 2. operating said phase changing means independently of said drive means to selectively change the position of said movable knife means forward and backward relative to the position of the fixed knife means.

15. The apparatus of claim 14 further including an indicator means connected to said registry changing means to that upon energization of said registry changing means, said indicator means indicates the change in length necessary to produce slots of substantially equal length made by said fixed and movable knife means in said box blank.

16. The apparatus of claim 14 further including an indicator means connected to said phase changing means so that upon energization of said phase changing means, said indicator means indicates the change in arc length between said fixed and movable knife means necessary to produce correct slot orientation in said box blank when a box blank of different size is to be slotted.

* * * * *